US005136993A

United States Patent [19]

Ampferer et al.

[11] Patent Number: 5,136,993

[45] Date of Patent: Aug. 11, 1992

[54] INTERNAL-COMBUSTION ENGINE OIL GUIDING HOUSING

[75] Inventors: Herbert Ampferer, Sachsenheim; Manfred Batzill, Neuhausen, both of Fed. Rep. of Germany

[73] Assignee: Dr. Ing. h.c.F. Porsche AG, Fed. Rep. of Germany

[21] Appl. No.: 643,892

[22] Filed: Jan. 22, 1991

[30] Foreign Application Priority Data

Jan. 19, 1990 [DE] Fed. Rep. of Germany ..... 4001468

[51] Int. Cl.[5] ..... F02F 7/00

[52] U.S. Cl. ..... 123/195 C; 123/196 R; 123/198 E; 184/106

[58] Field of Search ..... 123/195 C, 198 E, 196 R; 184/106, 6 S

[56] References Cited

U.S. PATENT DOCUMENTS

| | | | |
|---|---|---|---|
| 3,100,028 | 8/1963 | Booth et al. | 184/106 |
| 3,653,464 | 4/1972 | Jacobsen et al. | 184/6.2 |
| 4,270,497 | 6/1981 | Valeno | 123/195 |
| 4,474,463 | 10/1984 | Curley et al. | 123/195 C |
| 4,519,348 | 5/1985 | Hamilton | 123/195 C |
| 4,938,184 | 7/1990 | Martin et al. | 184/106 |
| 5,014,819 | 5/1991 | Gotou et al. | 184/6.5 |

FOREIGN PATENT DOCUMENTS

| | | |
|---|---|---|
| 2751982 | 5/1979 | Fed. Rep. of Germany . |
| 2923993 | 12/1980 | Fed. Rep. of Germany . |
| 3624325 | 8/1987 | Fed. Rep. of Germany . |
| 2230296 | 10/1990 | United Kingdom . |

*Primary Examiner*—E. Rollins Cross
*Assistant Examiner*—Erick Solis
*Attorney, Agent, or Firm*—Evenson, Wands, Edwards, Lenahan & McKeown

[57] ABSTRACT

An oil guiding housing is arranged below the crankcase of an internal-combustion engine and has a storage tank for lubricating oil and a housing part with a connection for an oil filter. In the pan part of the oil guiding housing situated directly below the crankshaft, a forward flow and return flow part for lubricating oil is integrated. The oil guiding housing ensures a targeted guiding of all lubricating oil flows and provides a good degassing of the oil.

16 Claims, 3 Drawing Sheets

1
8
17
18
16
9
S
S
65
10
64
63
62
20
38
37
19
61
60
65
11
36
16
E3
A
6
30
4
7
45
5
39
46
IV
IV
47
50
48
E1
E2

E1
49
48
53
52
51
50
7

16
51
46
48
47
35
25
24
23
50
49
52
48
7
E1

INTERNAL-COMBUSTION ENGINE OIL GUIDING HOUSING

BACKGROUND AND SUMMARY OF THE INVENTION

The present invention relates to an oil guiding housing and, more particularly, to a housing which is detachably fastened to a flange of the crankcase and ensures a targeted guiding of all lubricating oil flows and provides a good degassing of the lubricating oil of an internal-combustion engine.

The supply of an internal-combustion engine installed in a motor vehicle with lubricating oil under all operating conditions is a known problem. Critical conditions may occur, for example, when driving in steep terrain or, as a result of high centrifugal forces, during fast cornering. Under such conditions, the oil collects in the internal-combustion engine in areas from which no sufficient recirculating can take place into the lubricating system. Particularly in the case of high-speed internal-combustion engines, an air roll caused by the crankshaft drive and rotation in the crankcase hinders the return flow of the oil flowing out of the cylinder heads and causes an undesirable foaming.

In order to eliminate these problems, it is known, as shown DE-OS 27 51 982, to provide a return flow duct for the lubricating oil flowing back out of the cylinder heads which is cast into the end of the crankcase. From this duct, the oil reaches a closed duct which is arranged on the bottom of the flat oil pan part and leads into the oil sump.

In German Patent 36 24 325 C1, an oil pan is provided a sunk recess for the oil sump. The recess is partially covered by a metal sheet. The oil flowing back into the sump, by way of the metal sheet, is guided to a recess wall situated in the air stream whereby the oil is to be sufficiently cooled. This type of an arrangement cannot be used if the recess is covered by other components on the internal-combustion engine or the underbody of the motor vehicle is covered in order to achieve improved aerodynamics.

It is also known, particularly in motor sports, to provide a dry-sump lubrication. In this situation, in addition to the pump taking in oil from the crankcase, an additional pump is required which takes in the oil from a storage tank and supplies it to the internal-combustion engine under pressure. This solution requires two pumps and a corresponding number of lines with couplings and therefore requires high constructive expenditures and is expensive. In addition, the second pump produces loud noises, particularly in the case of high rotational speeds. The advantage is the fast recirculation of the oil into the lubricating system, a good degassing as well as a lubricating oil supply which is ensured also under extreme conditions.

It is an object of the present invention to avoid the above-mentioned disadvantages, particularly those of a dry-sump lubrication system and to ensure in an internal-combustion engine a targeted guiding of the lubricating-oil flows, an improved defoaming of the oil and an optimum supply of the internal-combustion engine with lubricating oil under all operating conditions.

This object has been achieved in accordance with the present invention by providing an oil guiding housing which has a pan part bounding the crank space in the downward direction and extending essentially parallel with respect to the crankshaft. Return flow devices which are separated from one another as well as a forward flow device are integrated in the housing for the lubricating oil. At one end of the oil guiding housing, a storage tank is arranged below the pan part into which the lubricating oil collected in the return flow devices flows by way of a single inlet opening. Inside the storage tank, a delay part and an oil pum are arranged to deliver the lubricating oil via the integrated forward flow device to the other end of the oil guiding housing. There, below the pan part on a housing part, a flange surface is arranged for the fastening of an oil filter. In the housing part, a thermostat is arranged for the oil-temperature-dependent control of the lubricating oil flow either by way of an oil cooler or directly into the internal-combustion engine.

The oil guiding housing of the present invention has the advantages of a dry-sump lubrication while avoiding its disadvantages. The separate lines and couplings which are required in the case of a dry-sump lubrication because of the physical separation of the oil pan and the storage tank are unnecessary because all required oil-carrying lines are integrated in the present invention. The configuration of the pan part, together with the part of the crankcase arranged above it, ensures a complete separation of the foamed oil flowing back from the crankshaft drive and the part of the lubricating oil which flows from the remaining points of the internal-combustion engine into the storage tank. In this storage tank, as a result of the delay part, the immediate short-circuit-type intake of the foamed oil by the oil pump is avoided and the oil is largely degassed.

The inlet opening, by virtue of which the pan part and the storage tank are connected with one another, is arranged almost centrally with respect to a horizontal cross-sectional plane of the storage tank. Thus, even in the case of extreme displacements of the oil level in the storage tank, a flowing-back into the pan part is prevented. In this situation, the delay part additionally avoids an excessively fast flowing-off of the oil from the direct environment of the intake strainer of the oil pump.

The arrangement of the oil filter on a housing part situated below the pan part prevents an emptying of the filter after the internal-combustion engine is switched off and thus an intake of air which, when the engine is restarted, may reach the lubricating system. Adjacent to the oil filter, the thermostat is integrated in this housing part which connects and disconnects the oil cooler.

A wall, which is arranged at one end of the oil guiding housing and which simultaneously bounds the pan part and the storage tank, is used as a large-area flange for a transmission so that a rigid connection is ensured of the internal-combustion engine and the transmission.

Preventing the oil which is not used for the immediate lubricating of the crankshaft drive from reaching the crankshaft drive as well as the above-described thorough degassing of the oil together have the effect that the components which require clean oil, such as the slide bearings, the hydraulic valve play compensating elements and the hydraulically actuated mechanisms for variable valve controls, can be operated without any problems at high rotational speed ranges.

At its underside situated opposite the inlet opening, the storage tank is closed off by a pan-shaped covering which makes the oil pump accessible. The delay part is constructed to be flange-shaped at its edge and has sealing devices that are integrated there. This edge is braced in the parting line between the storage tank and the covering and thus prevents an outflowing of oil. Adjacent to the edge, several passages are arranged which form the only connection from the storage tank to the strainer of the oil pump situated below the delay part.

The top side of the pan part, as part of the return flow device, has first and second grooves of which the first one is closed off by a corresponding design of a wall of the crankcase disposed above it. By way of several return flow ducts arranged along the internal-combustion engine, the oil flowing back from the cylinder heads is guided into this groove. A flowing of the oil out of the heads is therefore ensured even if the internal-combustion engine is tilting excessively. The covering of the second groove takes place by a rib arranged in the crankcase. The rib is placed in the direction of the crankshaft and has the effect of an oil lathe. The oil thrown off by centrifugal force, by way of the rib, arrives in this second groove which also receives oil flowing back from the cylinder heads.

The entire oil guiding housing, comprising the pan part, the housing part and the storage container, may be manufactured in one piece as a metallic diecast part or be made of plastic or be constructed from separate components. A one-piece construction as an aluminum diecast part ensures an inexpensive and fast manufacturing with precise measurements because no undercuts occur as a result of a corresponding design.

BRIEF DESCRIPTION OF THE DRAWINGS

These and further objects, features and advantages of the present invention will become more apparent from the following detailed description of a presently preferred embodiment when taken in conjunction with the accompanying drawings wherein.

DETAILED DESCRIPTION OF THE DRAWINGS

Figure 1:
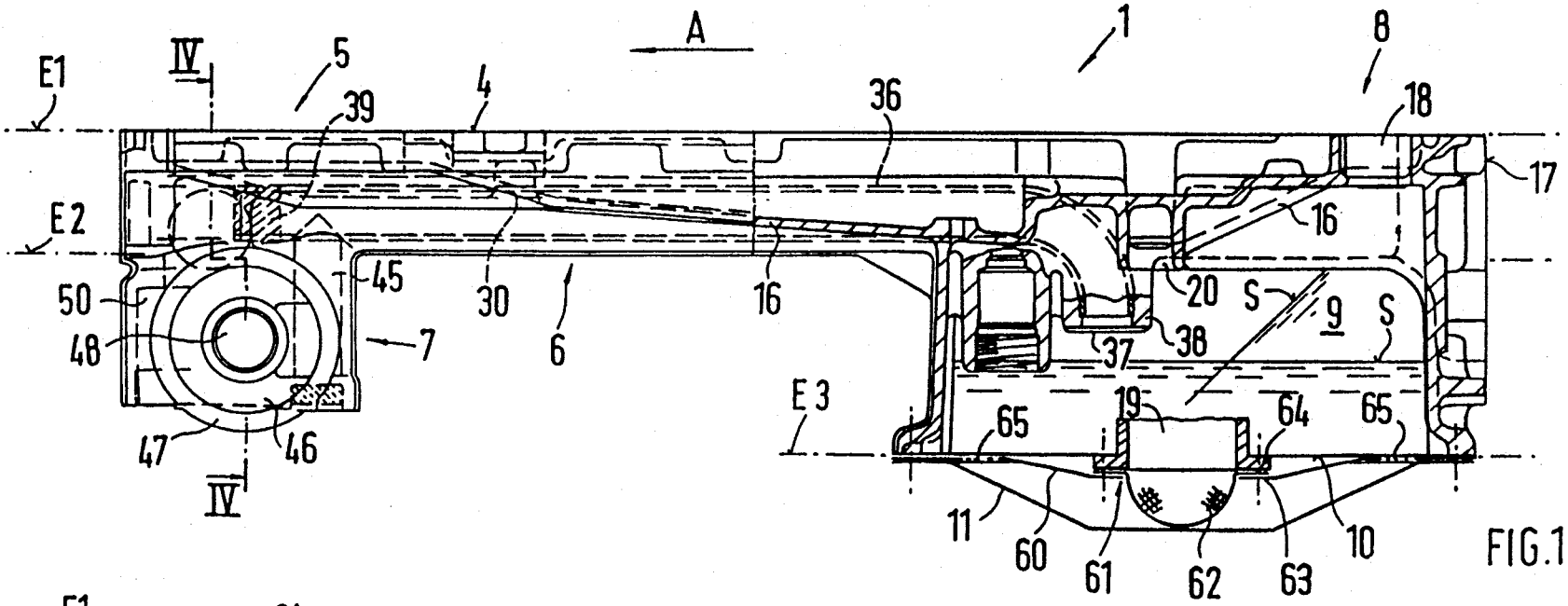
FIG. 1 is a lateral view of an oil guiding housing in accordance with the present invention with a partial sectional view along Line I—I of FIG. 2.
Figure 5:
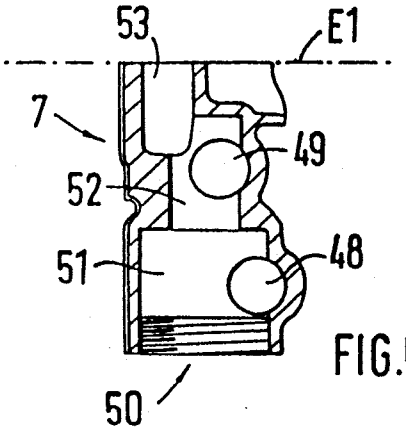
FIG. 5 is a sectional view along Line V—V of FIG. 2.
Figure 4:
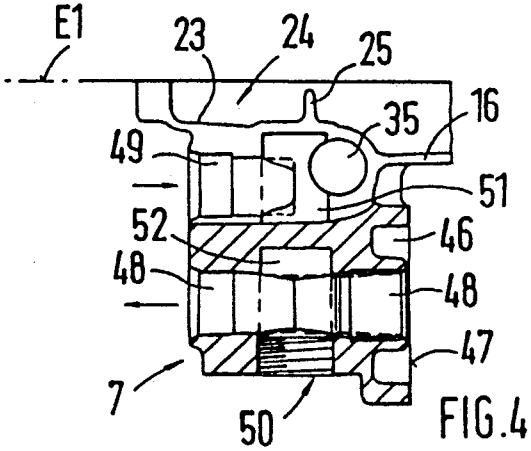
FIG. 4 is a sectional view along line IV—IV of FIG. 1.

An oil guiding housing 1 is fastened to a flange 2 of a crankcase bottom part 3 of an internal-combustion engine. The top part 4 of the oil guiding housing is situated in a horizontally extending plane E1. With respect to a driving direction represented by the arrow A, a housing part 7 is arranged on the front end 5 of the oil guiding housing 1 below a pan part 6. At the rear end 8, a storage tank 9 for lubricating oil is arranged below the pan part 6. The pan part 6 is bounded by the horizontal plane E1 and by a plane E2 which is in parallel to plane E1.

The open underside 10 of the storage tank 9 is situated in a horizontal plane E3 which bounds the oil guiding housing 1 in the downward direction. A covering 11, which is detachably held on the underside 10, closes off the storage tank 9. The pan part 6 which extends along the direction of arrows X—X of the oil guiding housing 1, in the plane E1, is essentially rectangular in construction, bounds the crank space 12 in a downward direction and extends essentially in parallel to the crankshaft 13. The pan part 6 is open with respect to the crankcase bottom part 3 and in the downward direction is bounded by a bottom 16. The pan part 6 extends from the end 5 to shortly in front of a wall on the end 8 which is constructed as a transmission flange 17. A compartment 18 remains between this flange 17 and the pan part 6 to receive a drive for an oil pump 19 starting from the crankshaft 13 (shown only outlined), and is fastened to the bottom 16 and is arranged in the storage tank 9.

The bottom 16 which separates the pan part 6 and the storage tank 9 from one another has an inlet opening 20 connecting these two parts and arranged almost centrally with respect to the cross-sectional surface of the storage tank 9 situated in the plane E3.

The pan part 6 has return flow devices 24 for the lubricating oil which extend in the direction of the arrows X—X (FIG. 2), and arranged adjacent to side walls 21. The return flow devices 24 comprise first and second grooves 22, 23 and are bounded toward the inside by webs 25. A collecting area 26 for lubricating oil extends in the direction X—X between the grooves 22, 23 and below the crankshaft 13. Starting from end 5, the bottom 16 of the collecting area 26 first has inclined surfaces 27 sloping downward from the outside toward the inside to which is connected a section 29 provided with a slight slope which reaches or extends to a step 28. From this step 28, the bottom 16 extends essentially in parallel to the plane E1 to the compartment 18 and as a result, partially covers the inlet opening 20.

Figure 2:
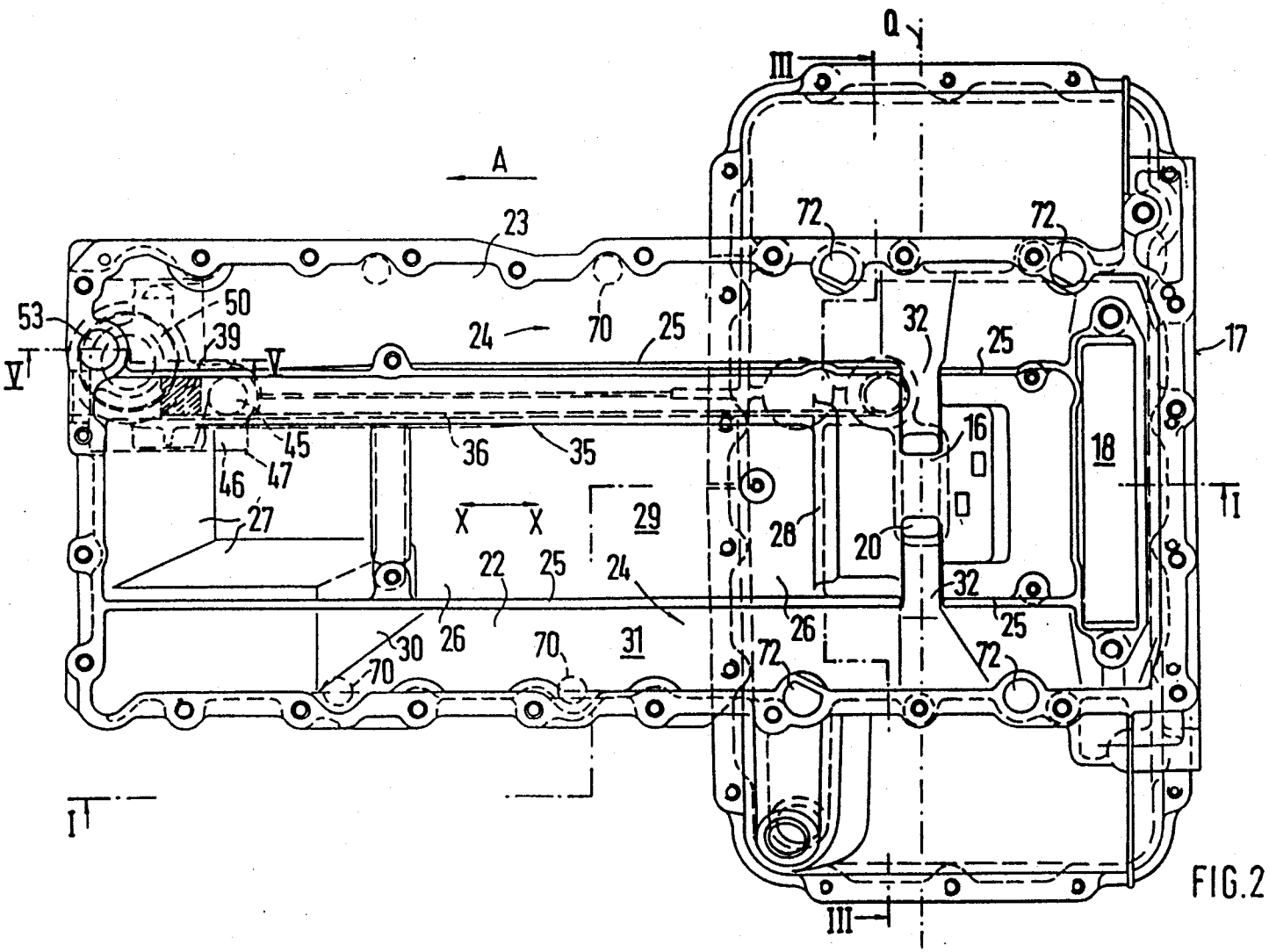
FIG. 2 is a top view of an oil guiding housing.

Starting from end 5, the first groove 22 extends first flat and in parallel to plane E1 before it changes by way of a slope 30 provided with an inclination into a slightly sloped section 31. The second groove 23 extends continuously from the end 5 with a slight slope. Both grooves 22, 23 have their lowest point adjacent to the inlet opening 20 at which the webs 25 are interrupted by notches 32 arranged in a transverse plane Q (FIG. 2). From this point, the bottom 16 extends in the grooves 22, 23 in an ascending manner up to the compartment 18.

Adjacent to the web 25 assigned to the groove 23, a tube 36 is cast into the bottom 16. The tube 36 is used as a forward flow device 35 for lubricating oil and has a bent inlet 37 into a connection piece 38 in the storage tank 9. The tube end is closed off by a stopper 39 approximately in the center above the housing part 7.

The housing part 7 has a vertically extending bore 45 which leads into the forward flow device 3 and the lower end of which is closed off. In addition, the bore 45 intersects a ring duct 46 which is part of a flange surface 47 for receiving an oil filter. A discharge bore 48 centrally penetrates the flange area 47 and extends axially perpendicular to the direction of the arrow X—X through the housing part 7 and leads into a line (not shown) and to an oil cooler. A line, which leads from the oil cooler to the housing part 7, is connected to a bore 49. A cylindrical two-step receiving device 50 extends parallel to the bore 45 and has a first step 51 penetrated by the discharge bore 48 and a second step 52 which forms the mouth of the bore 49. The step 52 is connected with a recess 53 which is open with respect to the plane E1.

A delay part 60 for lubricating oil is inserted into the storage tank 9 according to FIG. 1. The part 60 has a flange-shaped edge for bracing in the plane E3 between the storage tank 9 and the covering 11. This edge has integrated sealing devices. In the center of the delay part 60, an opening 61 is arranged through which a strainer 62 of the oil pump 19 is fitted from above and the edge 63 of which is screwed together with a flange 64 of the oil pump 19. The volume of the storage tank 9 is connected with the space between the covering 11 and the delay part 60 by way of several circular passages 65.

Figure 3:
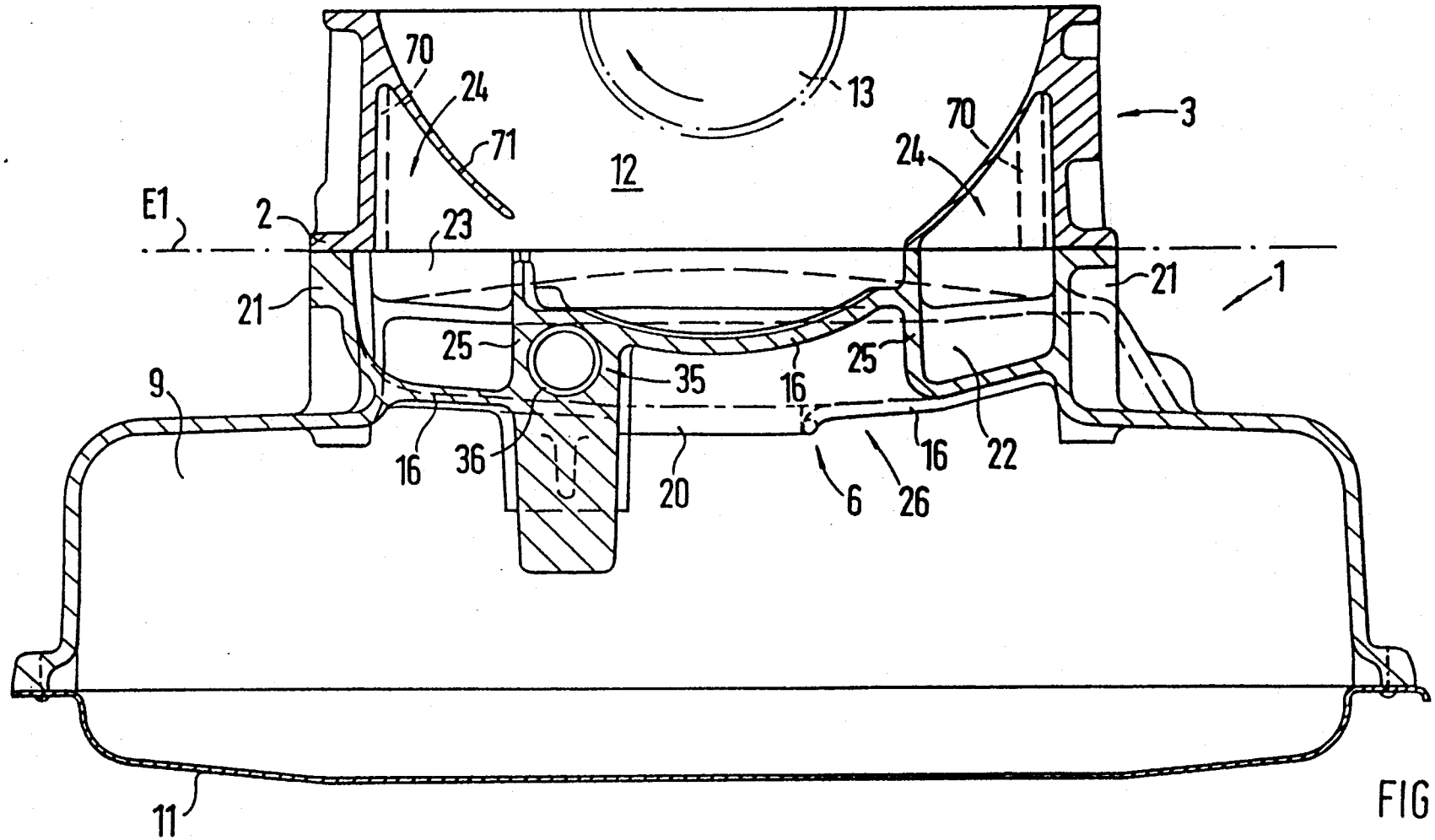
FIG. 3 is a sectional view along Line III—III of FIG. 2.

The side of the crankcase bottom part 3 which is situated in the plane E1, as shown in FIG. 3, is configured such that the first groove 22 is closed off. Return flow ducts 70 guide the oil flowing back from the cylinder heads into groove 22 as well as into the second groove 23 and are arranged in the crankcase. The ducts 70 lead into this closed part of the return flow device 24. The groove 23 is partially covered by a rib 71 which acts as an oil lathe and is orientated against the rotational direction of the crankshaft 12 to follow the approximately figure eight-shaped connecting rod contour. This rib 71 catches the oil thrown off by the crankshaft drive.

During the operation of the internal-combustion engine, the oil pump 19 delivers lubricating oil from the storage tank 9 through the forward flow device 35. By way of the bore 45, the oil reaches the ring duct 46 and from there the oil filter. An elastic material element (not shown) is inserted as a thermostat into the receiving device 50 and, in the cold state, permits the oil flowing out of the discharge bore 48 to reach the recess 53 by way of the step 52. From there, the lubricating oil arrives in the crankcase at all areas to be supplied.

After the oil has heated up the elastic element closes off the passage from step 51 to step 52 so that the oil, by way of the discharge bore 48, first reaches the oil cooler and from there enters the bore 49. Subsequently, the oil flows into the recess 53 by way of the step 52.

The oil flowing back from the cylinder heads reaches the grooves 22, 23 through several return flow ducts 70. The oil thrown off by the crankshaft drive reaches the second groove 23, for the most part, via the rib 71. Oil which drips off flows into the collecting area 26. The total amount of oil flows along the bottom 16 provided with the slope in the grooves 22, 23 or along the collecting area 26 to the inlet opening 20. The oil which is already partially degassed in the grooves 22, 23 acting as return flow devices 24 flows through the notches 32 and from there through the inlet opening 20 into the storage tank 9. The oil originating from the collecting area 26 flows around the step 28 and also reaches the inlet opening 20. Inside the storage tank 9, a short-circuit-type intake of the oil which is not yet sufficiently degassed is prevented by the delay part 60. The oil must flow at least from the inlet opening 20, which is situated almost centrally with respect to the storage tank 9, to the passages 65 which are situated close to the walls of this tank 9 and from there back to the centrally situated strainer 62. The time required for this delay is sufficient for largely degassing the oil. The venting of the storage tank 9 is ensured by bores 72 which, by way of lines in the crankcase which are not shown, are connected with the space of the internal-combustion engine which is situated above the cylinder head.

If, as a result of, for example, a hydraulic camshaft turning arrangement, an increased demand for lubricating oil exists in the cylinder, this increased amount of oil, by way of a line extending in one of the bores 72, can be guided directly from the cylinder head into the storage tank 9.

The oil that is not required at the crankshaft drive is completely separated from the oil-air mixture swirling in the crank space 12 and encounters the oil originating from the crankshaft drive only in the second groove 23 or in the storage tank 9. The almost central arrangement of the inlet opening 20 above the storage tank 9 prevents an unintentional flow-back into the pan part 6 even in the case of extreme displacements of the oil level S, as indicated in FIG. 1. In the case of strong centrifugal forces, the oil volume below the delay part 60 exhibits almost no displacement because the oil can be displaced only by way of the passages 65. Thus, it is ensured that oil always flows around the strainer.

The above-described embodiment of the invention uses a oil guiding housing 1 manufactured in one piece using a diecasting method. The delay part 60 is produced in one operation as a deep-drawn part made of sheet metal, on the outer boundary of which an elastomer sealing devices is subsequently mounted. The delay part 60 and the oil guiding housing may be made of plastic without limiting their functions and with minimal constructional changes.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. An oil guiding housing for an internal-combustion engine having a crankcase, a crankshaft, a crank space and integrated return flow ducts for lubricating oil flowing back from cylinder heads, comprising means for detachably fastening the housing to a flange of the crankcase, a pan part extending approximately parallel with respect to the crankshaft and which bounds the crank space adjacent tot eh crankshaft, and a forward flow device and a return flow device for lubricating oil arranged in the pan part and extending separately from one another so as to lead into a storage tank for lubricating oil which is held on the end side of the pan part and is separated therefrom by a bottom of the pan part, wherein a single inlet opening for the oil is arranged in the bottom of the pan part approximately in the center and above the storage tank.

2. The housing according to claim 1, wherein in the pan part, the return flow device comprises a first groove and a second groove between which is arranged the forward flow device comprising a tube.

3. The housing according to claim 1, wherein below a plane bounding the pan part and at the end side of the pan part, a housing part is operatively arranged having a flange surface for an oil filter and is operatively connected to the forward flow device.

4. The housing according to claim 3, wherein in the pan part, the return flow device comprises a first groove and a second groove between which is arranged the forward flow device comprising a tube.

5. The housing according to claim 1, wherein in the pan part, the return flow device comprises a first groove and a second groove between which is arranged the forward flow device comprising a tube.

6. The housing according to claim 5, wherein below a plane bounding the pan part and at the end side of the pan part, a housing part is operatively arranged having a flange surface for an oil filter and is operatively connected to the forward flow device.

7. The housing according to claim 2, wherein the grooves are bounded to the bottom, by exterior side walls of the pan part and by interior longitudinal webs having notches in a transverse plane (Q) adjacent to the inlet opening.

8. The housing according to claim 7, wherein below a plane bounding the pan part and at the end side of the pan part, a housing part is operatively arranged having a flange surface for an oil filter and is operatively connected to the forward flow device.

9. The housing according to claim 7, wherein the bottom essentially slopes downwardly from the front end of the oil guiding housing to the discharge opening, and ascends from there to a rear end of the pan part, and the bottom bounds a collecting area between the grooves in the center section of the pan part.

10. The housing according to claim 2, wherein the second groove is partially covered by a rib arranged in the crankcase and follows approximately a figure eight-shaped connecting rod contour, and the opposite first groove is closed off by a wall by the crankcase.

11. The housing according to claim 10, wherein below a plane bounding the pan part at the end side of the pan part, a housing part is operatively arranged having a flange surface for an oil filter and is operatively connected to the forward flow device.

12. The housing according to claim 1, wherein the grooves are bounded by the bottom, by exterior side walls of the pan part and by interior longitudinal webs having notches in a transverse plane (Q) adjacent to the inlet opening.

13. The housing according to claim 12, wherein the bottom essentially slopes downwardly from the front end of the oil guiding housing to the discharge opening, and ascends from there to a rear end of the pan part, and the bottom bounds a collecting area between the grooves in the center section of the pan part.

14. The housing according to claim 3, wherein an elastic material element is operatively arranged in the housing part for controlling an oil cooler as function of the oil temperature.

15. The housing according to claim 1, wherein a delay part is operatively arranged in the storage tank which is held braced by its outer boundary between an underside of the pan part and a covering which closes off the underside.

16. The housing according to claim 15, wherein the delay part has a central opening into which a strainer can be inserted and an opening edge supported on an oil pump.

* * * * *